US009124969B2

(12) United States Patent
McGhee et al.

(10) Patent No.: US 9,124,969 B2
(45) Date of Patent: Sep. 1, 2015

(54) LOUDSPEAKER RIGGING SYSTEM HAVING UPWARDLY EXTENDING CONNECTING LINKS

(75) Inventors: John McGhee, Parkdale, OR (US); Alejandro Garcia Rubio, Richmond, CA (US); Pablo Espinosa, Pleasanton, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 395 days.

(21) Appl. No.: 13/587,843

(22) Filed: Aug. 16, 2012

(65) Prior Publication Data

US 2013/0208936 A1 Aug. 15, 2013

Related U.S. Application Data

(60) Provisional application No. 61/524,217, filed on Aug. 16, 2011.

(51) Int. Cl.

| | |
|---|---|
| ***H04R 1/02*** | (2006.01) |
| ***H04R 9/06*** | (2006.01) |
| *H04R 27/00* | (2006.01) |
| *H04R 1/40* | (2006.01) |

(52) U.S. Cl.

CPC ..... *H04R 1/026* (2013.01); *H04R 1/02* (2013.01); *H04R 1/403* (2013.01); *H04R 27/00* (2013.01); *H04R 2201/025* (2013.01); *H04R 2201/401* (2013.01)

(58) Field of Classification Search

CPC ..... H04R 1/02; H04R 1/026; H04R 1/26; H04R 1/403; H04R 27/00; H04R 2201/021; H04R 2201/025

USPC ..... 381/87, 334–345, 386–387, 395; 181/144–145, 148, 150, 198–199

See application file for complete search history.

(56) References Cited

U.S. PATENT DOCUMENTS

| | | | | |
|---|---|---|---|---|
| 5,730,295 | A * | 3/1998 | Darby | 206/600 |
| 6,640,924 | B2 | 11/2003 | Messner | |
| 2004/0213425 | A1 * | 10/2004 | Simidian et al. | 381/335 |
| 2006/0210095 | A1 * | 9/2006 | Monitto et al. | 381/87 |
| 2009/0022354 | A1 | 1/2009 | Parker | |
| 2011/0305362 | A1 | 12/2011 | McGhee et al. | |

FOREIGN PATENT DOCUMENTS

WO PCT/US12/51233 11/2012

* cited by examiner

*Primary Examiner* — Matthew Eason

(74) *Attorney, Agent, or Firm* — Beeson Skinner Beverly, LLP

(57) ABSTRACT

A loudspeaker rigging system having upwardly extending connecting links comprises splay adjustment and pivot links slidingly disposed in splay adjustment and pivot link stowing channels in a frame structure for the sides of a loudspeaker in a stack of loudspeakers, the splay adjustment and pivot links upwardly movable from stowed to linking positions, in the linking position the splay adjustment and pivot links linkable with locking pin holes in the bottom of the frame structure of a superjacent loudspeaker, the splay adjustment link having a plurality of splay angle slots of various lengths, the splay angle slots aligned with a plurality of splay angle selection pin holes in the frame structure, such that upon insertion of a linking pin in a selected splay angle selection pin hole and corresponding aligned splay angle slot the splay angle link may be raised upward to a selected splay angle.

18 Claims, 11 Drawing Sheets

LOUDSPEAKER RIGGING SYSTEM HAVING UPWARDLY EXTENDING CONNECTING LINKS

CROSS-REFERENCE TO RELATED APPLICATIONS

This application claims the benefit of U.S. Provisional Application No. 61/524,217, filed Aug. 16, 2011.

BACKGROUND

1. Field of the Invention

The present invention relates to loudspeaker rigging systems and more particularly to rigging hardware for suspending a stacked array of loudspeakers of a sound reinforcement system at a predetermined location relative to an audience. The present invention has particular application in rigging a stacked array of loudspeakers wherein a vertical splay between loudspeakers is desired to achieve a desired coverage and acoustic performance.

2. Description of Related Art

Sound systems for large venues typically involve the suspension or "flying" of stacks of loudspeakers in vertical arrays to achieve a desired acoustic output and coverage for a large audience. Such vertical stacks of loudspeakers are typically suspended and held together by rigging systems which may be attached to rigging hoists which position the stack at a desired elevation and location, typically above or in the vicinity of a performance stage. A flown stack of loudspeakers can include many speaker boxes and the rigging system for flying the stack must be strong enough to support the weight of the large stack. Such rigging systems generally involve the use of metal side frame elements secured to the speaker boxes that can be used to link the speakers together in a stacked arrangement and to lift the stack to an overhead flying position.

Typically, the individual speaker boxes of a vertical stack of loudspeakers held by a rigging system will have to be adjusted to meet the requirements of a particular application. Setting the proper angle between speakers, or "splay angle," can be critical to achieving desired acoustic performance and minimizing interference between the acoustic output of speakers in the stack. Splay angles are adjusted by adjusting the linkages between the rigging frames of the stacked speakers to create a desired angle. One such adjustment method is disclosed in U.S. Pat. No. 6,640,924 issued Nov. 4, 2003 to Ian Messner (the "Messner patent"). The Messner patent discloses a rigging system wherein the splay angle is adjusted by a cam plate that pivotally extends down from the bottom front end of the side frame of one loudspeaker to engage the top front end of the side frame of the loudspeaker directly below. To set the splay angle, the cam plate must be manipulated into a cam plate receiving channel in the top of the underneath side frame and pinned when the desired cam hole is aligned with the pin hole in the subjacent frame.

An improved rigging system is disclosed in U.S. Pat. No. 7,693,296 issued Apr. 26, 2010 to John Monitto (the "Monitto patent"). The Monitto patent discloses a side frame for a loudspeaker and associated pivot and splay adjustment links. The pivot and splay adjustment links are maneuverable using a gripping structure and are downwardly extendible from stow channels in the bottom corner regions of the frame structure into receiving channels in top corner regions of the frame structures of subjacent loudspeakers. The bottom extended end of the splay adjustment link includes an array of pin holes which can be selectively matched with one pin hole in one or more rows of pin holes provided in the bottom corner region of the side frame thereby permitting adjustments of the splay angle over a range of angles. This system requires that each pair of loudspeakers be interlinked one at a time by releasing the links into the receiving channel in the frame structure of the subjacent loudspeaker, pinning them in place, and then using a hoist to lift the top loudspeaker or stack of loudspeakers to line up the pin holes in the splay adjustment link with the pin holes in the bottom corner region of the side frame. This can not only time be consuming, but becomes progressively more difficult as the number and added weight of rigged loudspeakers in a stack of loudspeakers increases. The increasingly heavy stack of loudspeakers can bounce when lifted by a rigging hoist making it difficult for the pin holes in the side frames to align with the pin holes in the links and increasing the potential for physical injury to the equipment and to riggers.

There is thus a need for a rigging system for loudspeakers that does not require lifting and precisely aligning each pair of loudspeakers in a stack of loudspeakers that is being interlinked. There is also a need for a rigging system having links in side frames that can be used for interlinking adjacent loudspeakers by moving only the links rather than all the loudspeakers in a stack of loudspeakers above the loudspeaker being linked. There is also a need to provide a rigging system that is relatively easy to assemble and that has small incremental splay angle adjustment capabilities.

BRIEF DESCRIPTION OF THE ILLUSTRATIONS

DETAILED DESCRIPTION OF THE ILLUSTRATED EMBODIMENT

Figure 1A:
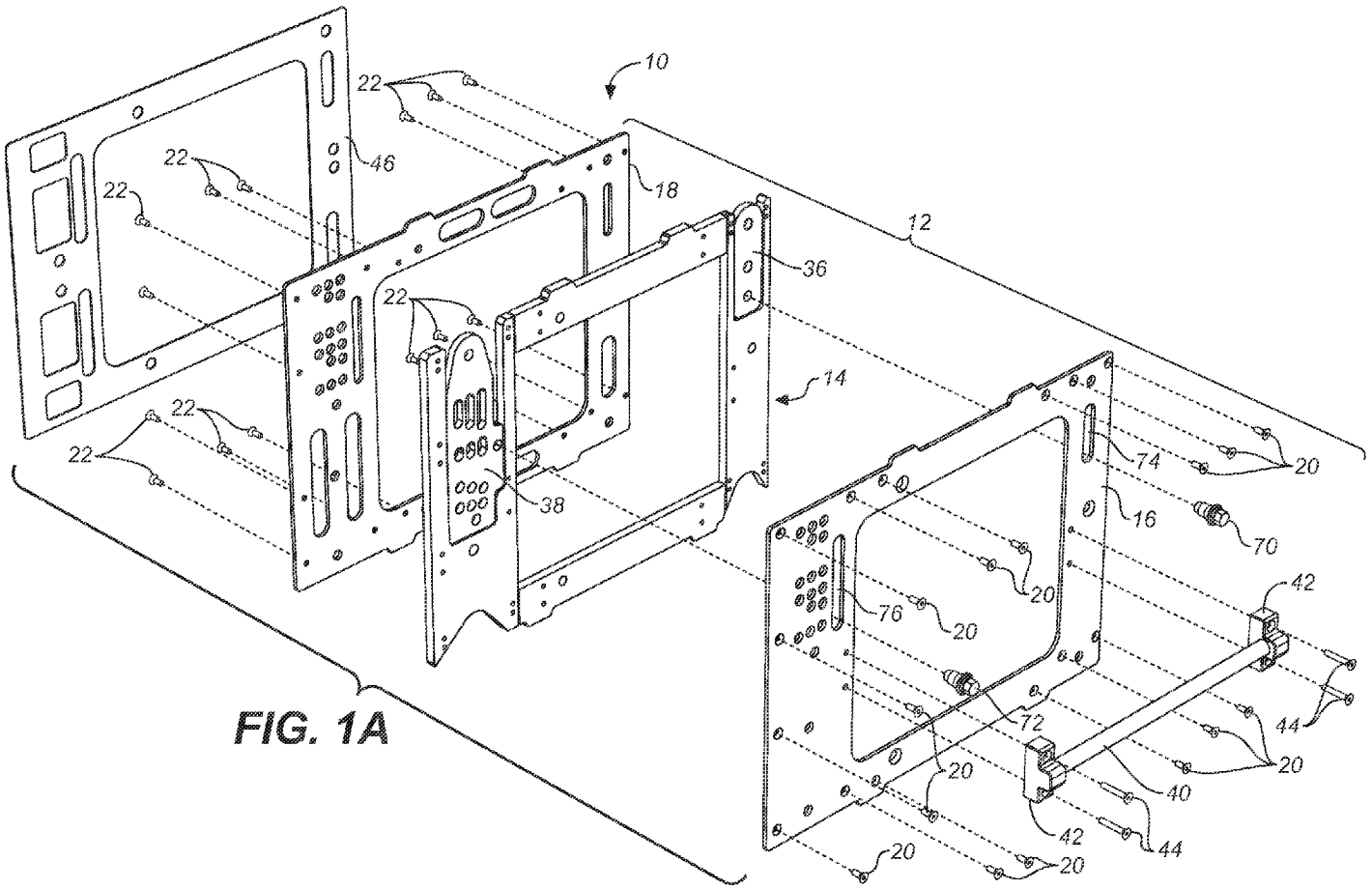
FIG. 1A is an exploded upper perspective view of a loudspeaker rigging system having upwardly extending connecting links.
Figure 1B:
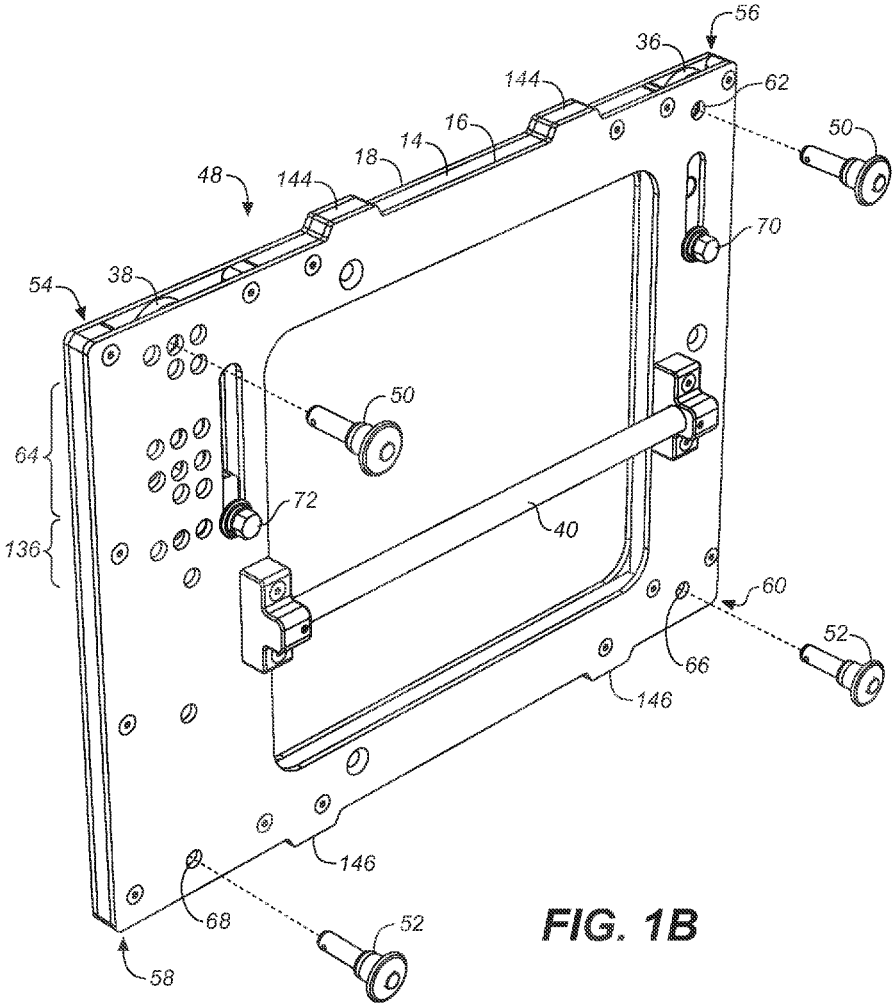
FIG. 1B is an upper left perspective view of the frame structure of the loudspeaker rigging system of FIG. 1A.
Figure 2:
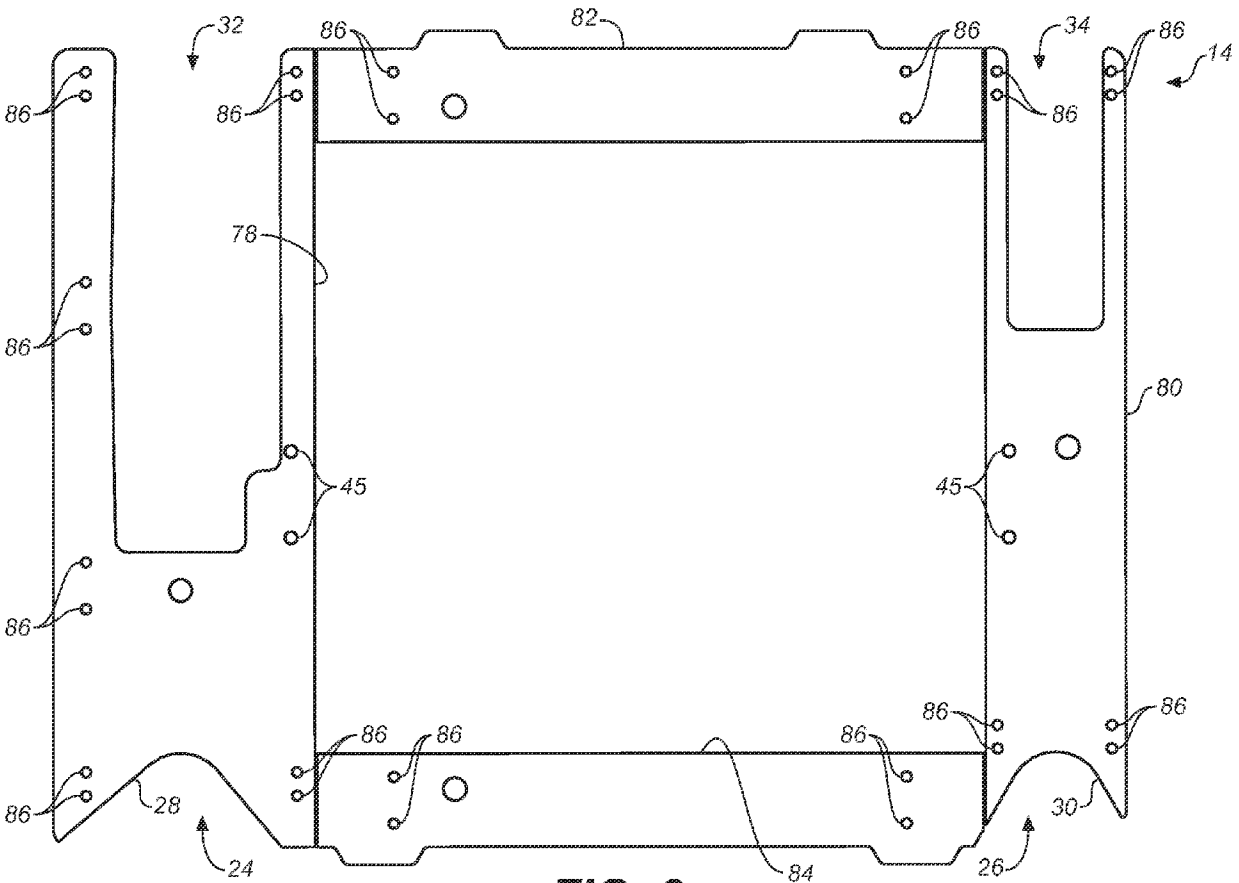
FIG. 2 is an elevation view of the center core assembly of the frame structure shown in FIG. 1B.

A loudspeaker rigging system having upwardly extending connecting links is indicated generally at 10 in FIG. 1A and comprises a frame assembly 12 having a core assembly 14 sandwiched between outer and inner side plates 16, 18 that are secured to the core assembly 14 by suitable outer and inner fasteners 20, 22 as shown in FIG. 1B. As best seen in FIG. 2, the bottom corners of the core assembly have two cutout portions 24, 26 forming guide surfaces 28, 30 for link receiving channels of the frame assembly as hereinafter described. The top corners of the frame assembly 12 have two open regions 32, 34 forming stowing channels for retaining the pivot link 36 and splay adjustment link 38 discussed in detail below.

With reference again to FIG. 1A, the frame assembly 12 also includes a crossbar 40 which serves as a handle or stepping rail found on conventional rigging cranes. The crossbar 40 extends between two brackets 42 which are attached to the outer side plate 16 with suitable fasteners 44 which are engaged with fastener receiving holes 45.

FIG. 1A also shows a gasket 46 conforming to the shape and configuration of the frame assembly 12. This gasket 46 is formed from a suitably flexible material and can be used behind the frame assembly when the frame assembly is mounted to the side of the loudspeaker. The backside of the gasket 46 will be provided with a suitable adhesive material to affix it to the loudspeaker when the frame is being mounted thereon.

It will be understood that the frame assembly 12 could be formed as a unitary frame structure instead of an assembly of parts.

Figure 6:
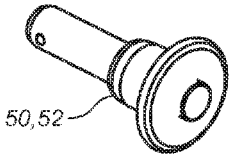
FIG. 6 is an upper perspective view of a typical locking pin.

FIG. 1B shows the frame assembly seen in FIG. 1A assembled into a frame structure 48 with the pivot link 36 and splay adjustment link 38 in their respective stowing channels. The assembled frame structure has a generally rectangular shape conforming to the sides of a conventional loudspeaker and has front and back top corner regions 54, 56 and front and back bottom corner regions 58, 60. The bottom corner regions 58, 60 receive the connecting links 36, 38 carried in the top corner regions 54, 56 of the side frame of a subjacent loudspeaker, as described below, for interlinking two adjacent loudspeakers. Locking pins 50, 52 are used to pin the connecting links in place, as later described, by inserting bottom locking pins 52 through bottom locking pin holes 66, 68 and also by inserting top locking pins 50, 52 through one of the splay angle selection pin holes 64 and pivot link locking pin hole 62 located in the top corner regions 54, 56 of frame structure 48. Suitable locking pins are commercially available quick release pins such as shown in FIG. 6.

FIG. 1A also shows gripping knobs 70, 72 which attach to connecting links 36, 38 and which extend from the outer plate 16 of the frame structure so that they can be gripped by a rigger of a loudspeaker system. More specifically, gripping knob 70 is attached to the pivot link 36 through a vertical guide slot 74 formed in the outer plate 16 adjacent the pivot link 36. Similarly, gripping knob 72 is attached to splay adjustment link 38 through a vertical guide slot 76 formed in the opposite side of outer plate 16 adjacent the splay adjustment link 38. By gripping the extended knobs 70, 72, a rigger can move the connecting links 36, 38 up or down to the full extent of the vertical guide slots 74, 76 without having to grab onto the links themselves. This reduces the risk that a rigger's hand can be caught between a link and a rigging frame or between the rigging frames of two adjacent loudspeakers.

With reference again to FIG. 2, it is seen that the core assembly 14 includes a splay adjustment link frame member 78, a pivot link frame member 80, and top and bottom bridging bars 82, 84 extending between frame members 78, 80. Frame members 78, 80 and bridging bars 82, 84 are rigidly held in relation to each other when outer and inner side plates 16, 18 are attached thereto using fasteners 20, 22 which are threaded into fastener receiving holes 86. It will be understood that the core assembly 14 may be formed as a single piece instead of being manufactured in sections as shown.

Figure 3:
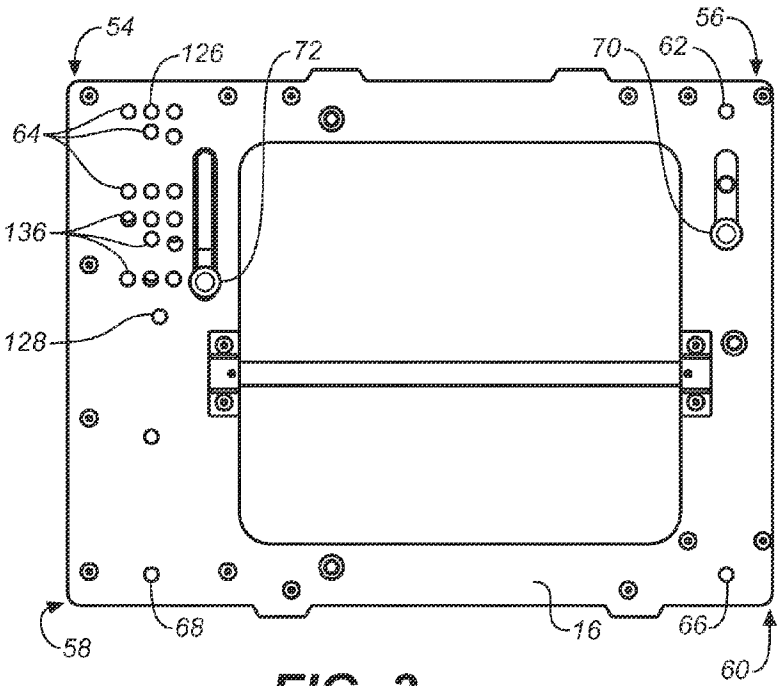
FIG. 3 is an elevation view showing the frame structure of the loudspeaker rigging system of FIG. 1.

FIGS. 3, 4A, 4B and 4C show connecting links 36, 38 in their respective stowing channels in stowed and upwardly extended linking positions. The outer plate 16 of the assembled frame structure 48, shown in FIG. 3, is removed in FIGS. 4A-4D for illustrative clarity. FIG. 5 illustrates a gripping knob in detail. A suitable gripping knob such as that shown in FIG. 5 is described in detail in the Monitto patent referred to above. FIG. 6 illustrates a locking pin. And FIGS. 8 and 9 illustrate connecting links 36, 38 in greater detail.

Commercially available quick release pins such as shown in FIG. 6 can be used as both top and bottom locking pins 50, 52. A suitable quick release pin is a single acting positive locking pin having a corrosion resistant steel spindle such as that manufactured by Jergens, Inc. of Cleveland, Ohio. A suitable quick release pin has an elongated steel spindle with a leading chamfered end and a gripping end. A thumb actuated, depressible release button activates an internal spring release mechanism which permits detente balls to be retracted when the pin is pressed through the locking pin holes and locking pin stowing holes in the rigging structures and links. With the pin inserted, release of the button will cause the quick release pin to lock into place.

It will be appreciated that a loudspeaker rigging system employing rigging side frames in accordance with the invention will have two frames, one for each side of the loudspeaker, enabling each loudspeaker to be rigged in a loudspeaker stack. Each side frame will nominally have one associated splay adjustment link 38 and one associated pivot link 36, each of which can be stowed in and deployed from the frame structure. Each rigging side frame is also capable of receiving the upper ends of a splay adjustment link and a pivot link associated with a side frame of a vertically subjacent loudspeaker within the stack of loudspeakers.

Figure 8:
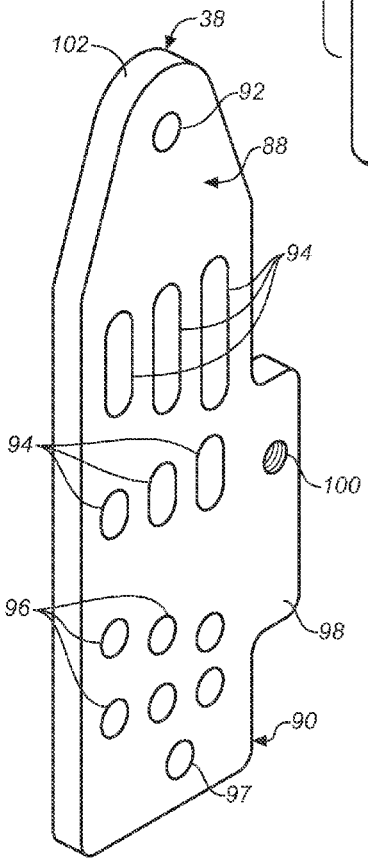
FIG. 8 is an upper perspective view of a splay adjustment link.

FIG. 8 shows the splay adjustment link 38 which has an extendible top end 88 and a base end 90. The top end has a top pin hole 92, and the base end 90 has an array of vertically extending splay angle slots 94 and a plurality of splay angle pin holes 96. A lateral extension 98 on one side of base end 90 has a threaded hole 100 for receiving gripping knob 72 (seen in FIG. 1A). The extendible top end 88 of the splay adjustment link 38 has a rounded top surface 102 that corresponds to the downward facing guide surface 28 of the splay adjustment link receiving channel 104 in the bottom corner region 58 of the frame structure 48. See FIGS. 1B and 4A. The receiving channel 104 is formed between the side plates 16, 18 by the cutout 24 in the frame structure's core assembly 14. See FIGS. 1A and 2. Front bottom locking pin hole 68 in the outer and inner side plates 16, 18 is located centrally of receiving channel 104 (see FIGS. 1B, 3, and 4A) such that, when the extendible top end 88 of a splay adjustment link 38 is lifted into the receiving channel 104, the top surface 102 thereof engages with guide surface 28 so that top end hole 92 aligns with locking pin hole 68 as shown in FIG. 4C. This guided self-alignment facilitates pinning of the splay adjustment link 38 to the front bottom corner region 58 of the frame structure of the rigging side frame of a superjacent loudspeaker when rigging a stack of loudspeakers.

Figure 7:
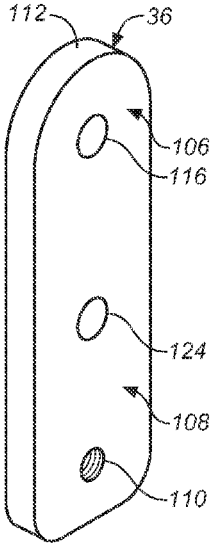
FIG. 7 is an upper perspective view of a pivot link.

FIG. 7 shows pivot link 36 which has an extendible top end 106 and a base end 108. Base end 108 has a gripping knob attachment aperture 110 for receiving gripping knob 70 (see FIGS. 1A and 5). The top end 106 of pivot link 36 has a convex top surface 112 similar to the rounded top surface 102 of splay adjustment link 38. Convex top surface 112 corresponds to the downward facing guide surface 30 of the pivot link receiving channel 114 in the back bottom corner region 60 of the frame structure 48. See FIG. 4A. The pivot link receiving channel 114 is formed between side plates 16, 18 by the cutout 26 in the frame structure's core assembly 14. See FIGS. 2, 3, and 4A. Back bottom locking pin hole 66 in the outer and inner side plates 16, 18 is located centrally of receiving channel 114 (see again FIGS. 1B, 3, and 4A) such that, when the top end 106 of a pivot link 36 is lifted into receiving channel 114, the top surface 112 of the top end 106 of pivot link 36 engages with the downward facing guide surface 30 of pivot link receiving channel 114 which guides and positions the top end 106 in receiving channel 114 so that upper pin hole 116 aligns with locking pin hole 66 in the back bottom corner region 60 of frame structure 48. As with the splay adjustment link receiving channel, this self-alignment feature facilitates pinning of the pivot link 36 to the bottom corner region 60 of the frame structure of the rigging side frame of a superjacent loudspeaker.

With reference again to FIGS. 2, 4A, 4B and 4C, it is seen that a splay adjustment link stowing channel 118 and a pivot link stowing channel 120 are provided in the front and back top corner regions 54, 56 of frame structure 48 vertically opposite the frame structure's bottom link receiving channels 104, 114. As mentioned above, the stowing channels 118, 120 are formed by open regions 32, 34 in the frame assembly's core assembly 14, which are bounded by outer and inner side plates 16, 18. Alignment of the pivot link locking pin hole 62 (see, e.g., FIG. 3) in the back top corner region 56 of the frame structure 48 with the pivot link's upper pin hole 116 (see, e.g., FIG. 4A) allows the pivot link 36 to be pinned in the stowed position $\mathbf{36}_S$ shown in FIG. 4A, and alignment of the pivot link locking pin hole 62 with the pivot link's lower pin hole 124 allows the pivot link 36 to be pinned in the linked position $\mathbf{36}_L$ as shown in FIGS. 4B and 4C. Similarly, alignment of the front top center splay angle selection hole 126 in the top corner region 54 of the frame structure 48 (see FIG. 3) with the splay adjustment link's top pin hole 92 allows the splay adjustment link 38 to be pinned in the stowed position $\mathbf{38}_S$ shown in FIG. 4A.

As mentioned above with respect to FIG. 8, alignment of the bottom locking pin hole 68 in the front bottom corner region 58 of the frame structure 48 with the top pin hole 92 of the splay adjustment link 38 of the rigging frame of a subjacent loudspeaker allows the splay adjustment link 38 to be pinned to the adjacent rigging frame in the linking position $\mathbf{38}_L$ shown in FIG. 4C. FIG. 4C is similar to FIG. 4A but additionally shows a splay adjustment link 38' extending from the side frame 48' (partially illustrated) of a subjacent loudspeaker connected in the linking position $\mathbf{38}_L$ to the above frame structure 48. FIG. 4C also shows a pivot link 36' from the side frame 48' of the subjacent loudspeaker connected to the frame structure 48 in the linked position $\mathbf{36}_L$. When the splay adjustment link 38 is in the linking position $\mathbf{38}_L$, bottom splay angle locking pin hole 128 of frame structure 48 (see FIG. 3) aligns with the splay adjustment link's bottom splay angle pin hole 97 (see FIGS. 4B and 8) allowing splay adjustment link 38 to be pinned and locked in the linking position $\mathbf{38}_L$ such as when transporting an interlinked stack of loudspeakers.

With continuing reference to FIG. 4C, it can be seen that when the splay adjustment link 38 is in the linking position $\mathbf{38}_L$, the splay angle selection pin holes 64 in the outer and inner side plates 16, 18 align with the splay angle slots 94 in the splay adjustment link 38. See also FIGS. 3 and 4B. The splay angle slots 94 facilitate selection of a precise splay angle between the side frames of two adjacent loudspeakers. When the splay adjustment link 38 has been pinned in the linking position $\mathbf{38}_L$ seen in FIG. 4C, a top pin 50 can be inserted in one of the splay angle selection pin holes 64 (see again FIG. 3), and thereby into the corresponding splay angle slot 94 of the splay adjustment link 38, according to the splay angle at which it is desired to rig the frame structure with respect to a superjacent frame structure. Once the pin has been inserted in the desired splay angle selection pin hole 64, the splay adjustment link 38 can be moved upward from the linking position $\mathbf{38}_L$ to a selected one of a plurality of splay angle positions shown in FIG. 9 reached when the lower end 95 of the selected splay angle slot 94 engages with the pin 50 that has been inserted into the selected splay angle selection pin hole 64, which thereby limits further upward movement of the splay adjustment link 38. A representative splay angle position $\mathbf{38}_A$ of the splay adjustment link 38 with respect to frame structure 48 is shown in FIG. 4D. When the splay adjustment link 38 has been moved to a selected splay angle position as shown in FIG. 9, one of the splay angle locking pin holes 136 provided in outer and inner side plates 16, 18 aligns with one of the splay angle pin holes 96 provided in the base end 90 of splay adjustment link 38. Therefore, the splay adjustment link 38 can be locked in place by inserting another pin into the aligned splay angle locking pin hole 136 and splay angle pin hole 96.

Figure 9A:
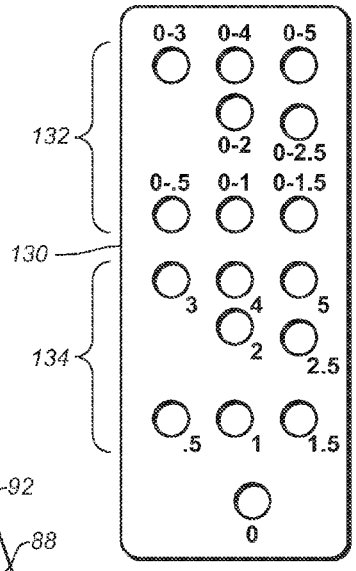
FIG. 9A is a close-up elevation view of the marking plate seen in FIG. 9.
Figure 9:
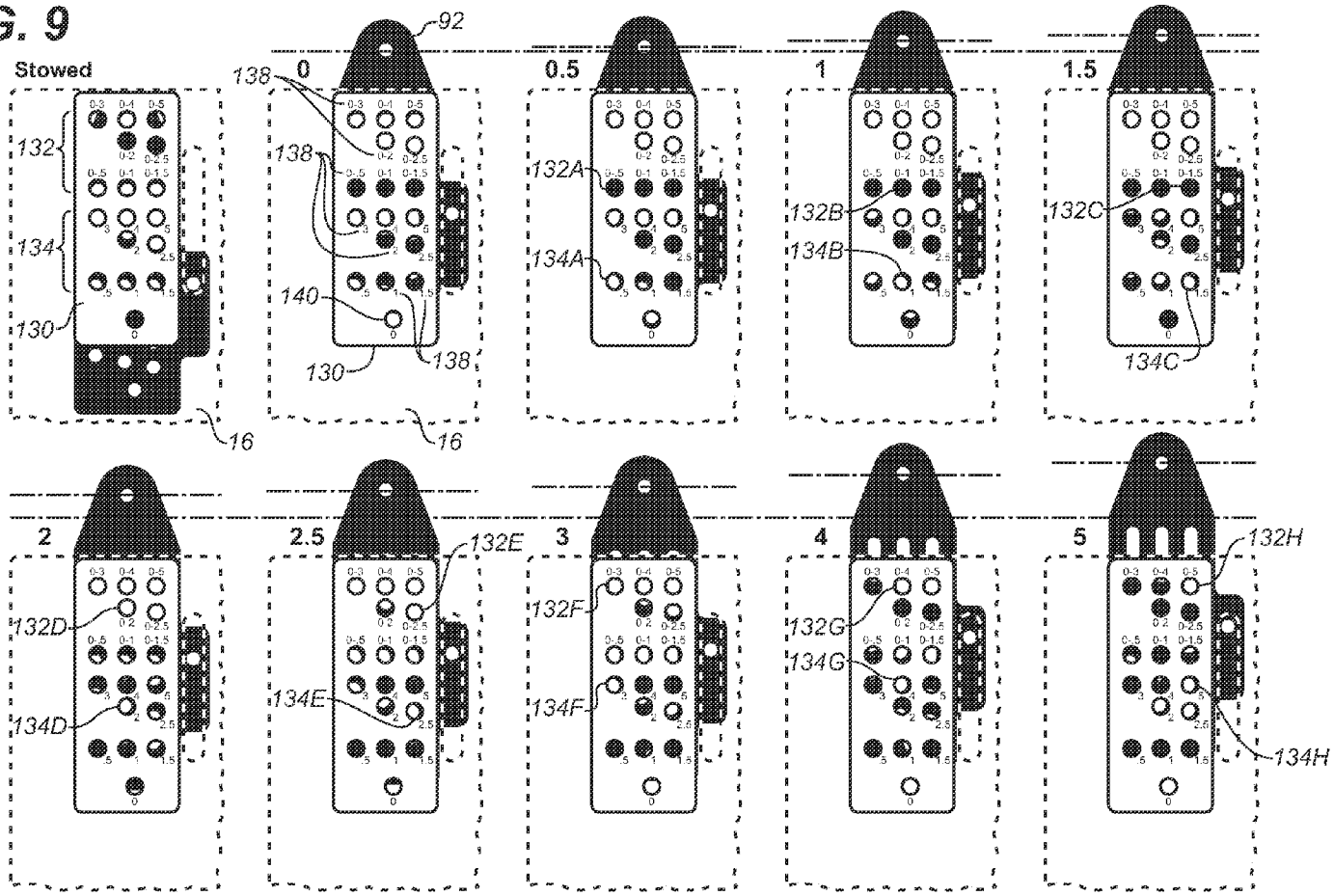
FIG. 9 is an elevation view showing a marking plate overlaying an outer side plate according to the invention and showing the splay adjustment link in various positions each representing a selected splay angle.

Referring now to FIGS. 9 and 9A, a marking plate 130 having an array of upper and lower indicator holes 132, 134 arranged in a pattern corresponding to the splay angle selection pin holes 64, and the splay angle locking pin holes 136, respectively, provided in outer and inner side plates 16, 18, is attached to outer side plate 16. The marking plate 130 has indicia 138 adjacent each of the upper indicator holes 132 to indicate the angular range through which the side frame will travel when the splay adjustment link 38 is moved upward if a locking pin is resident in the splay angle locking pin hole 64 corresponding to the selected upper indicator hole 132. For example, if it is determined to rig the loudspeaker at a splay angle of 0.5°, a rigger can insert a pin in upper indicator hole 132A. Similarly, if it is desired to rig the loudspeaker at splay angles 1°, 1.5°, 2°, 2.5°, 3°, 4° or 5°, the rigger will insert a second pin in one of upper indicator holes 132B, 132C, 132D, 132E, 132F, 132G, and 132H, respectively. The indicia 138 at each of the lower indicator holes 134 in marking plate 130 indicates the splay angle at which the side frame will be locked with respect to a superjacent side frame when a pin is inserted in a selected one of the splay angle locking pin holes 136 and the splay adjustment link's corresponding splay angle pin hole 96. For example, if the splay adjustment link 38 has been raised to a splay angle of 0.5°, insertion of a pin in lower indicator hole 134A will lock the splay adjustment link in place with the side frame at 0.5° splay with respect to an adjacent side frame. Similarly, if the splay adjustment link 38 has been raised to splay angles 1°, 1.5°, 2°, 2.5°, 3°, 4° or 5°, the rigger can lock link 38 in place by inserting a pin in lower indicator holes 134B, 134C, 134D, 134E, 134F, 134G, and 134H, respectively. Finally, if it is desired to lock the splay adjustment link 138 in the linking position $\mathbf{38}_L$, equivalent to splay angle 0°, a pin may be inserted in bottom indicator hole 140.

It will be understood by those of skill in the art that marking plate 130, while providing a useful template for the rigger, is not strictly necessary to practice the invention. It should also be appreciated that the splay angles provided may vary from those shown in the illustrated embodiment.

Figure 4A:
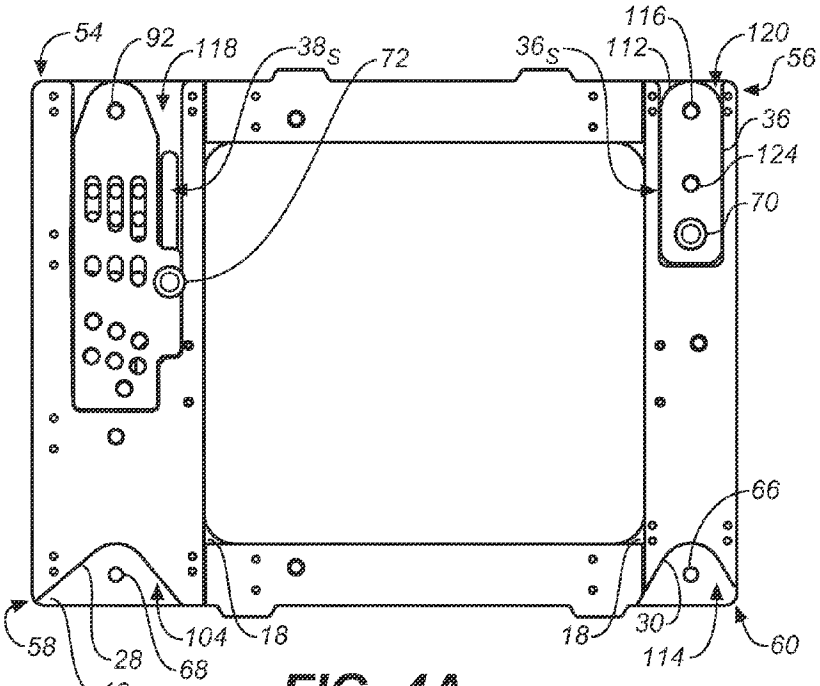
FIG. 4A is an elevation view similar to FIG. 3 showing the frame structure of the loudspeaker rigging system but with the front side plate removed.
Figure 4B:
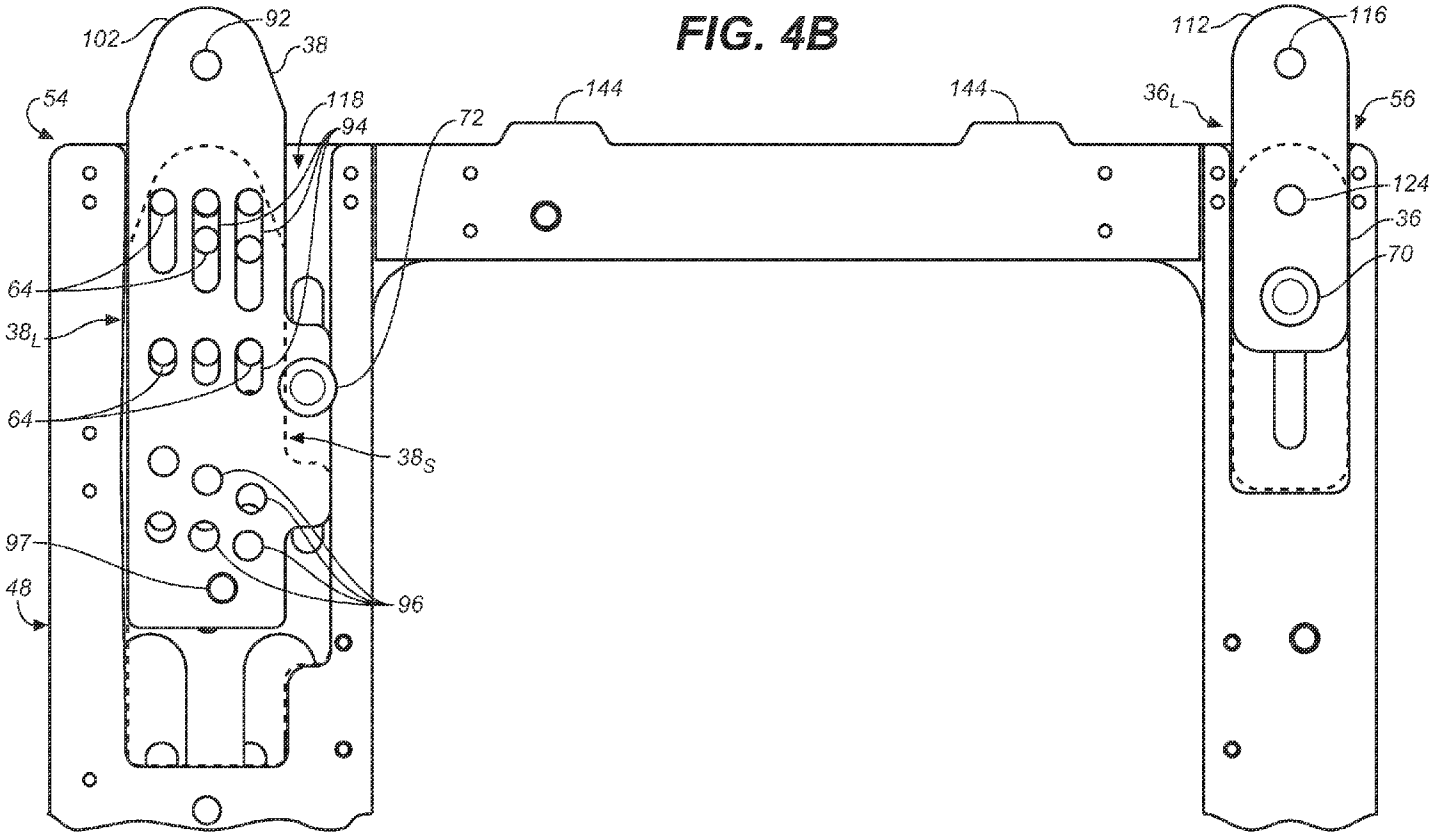
FIG. 4B is close-up elevation view similar to FIG. 4A showing upward movement of the connecting links.
Figure 4C:
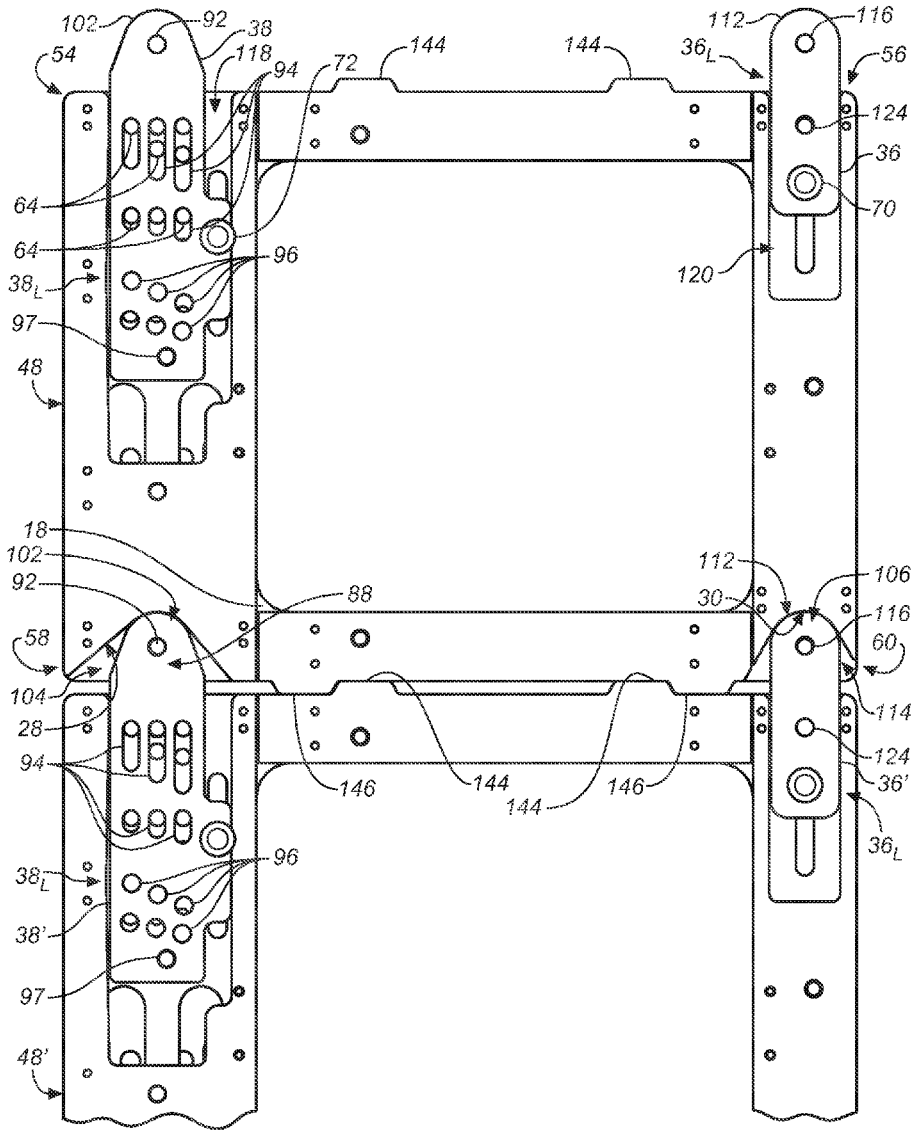
FIG. 4C is an elevation view similar to FIG. 4A showing the frame structures of a pair of vertically adjacent loudspeakers with the connecting links upwardly deployed.
Figure 4D:
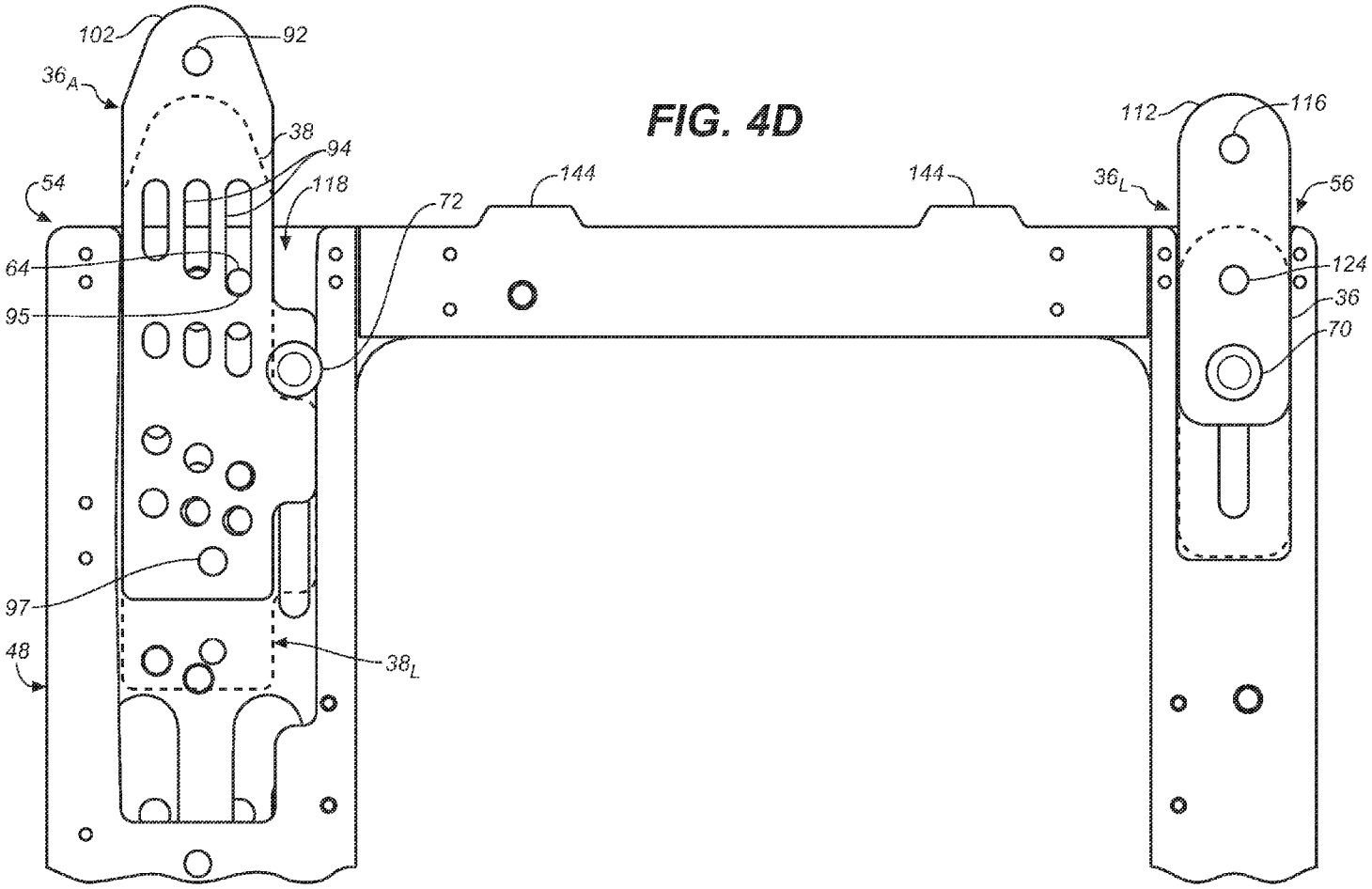
FIG. 4D is an elevation view similar to FIG. 4B showing movement of the splay adjustment link to one of a plurality of splay angle positions.
Figure 5:
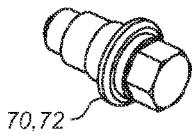
FIG. 5 is an upper perspective view of a gripping knob used for maneuvering the connecting links.

When transporting an interlinked stack of loudspeakers, one of the top pins 50 may be inserted in pivot link locking pin hole 62 in the outer and inner side plates 16, 18 of the side frame and through the pivot link's upper pin hole 116 to secure the pivot link 36 in the stowed position $\mathbf{36}_S$ shown in FIGS. 3 and 4A. One of the bottom pins 52 may be inserted in the back bottom locking pin hole 66 in the outer and inner side plates 16, 18 of the side frame to store it during transit and so that it is readily available when rigging a stack of loudspeakers. Similarly, during transit one of the top pins 50 may be inserted in the top center splay selection hole 126 of outer and inner side plates 16, 18 through the splay adjustment link's top pin hole 92, and one of the bottom pins 52 may be inserted into bottom splay angle locking pin hole 128 of the outer and inner side plates 16, 18 and through the splay adjustment link's bottom splay angle pin hole 97, in order to secure the splay adjustment link 38 in the stowed position $\mathbf{38}_S$ shown in FIGS. 3 and 4A.

To interconnect the rigging side frames of two adjacent loudspeakers in a stack of loudspeakers, the pivot link 36 is first released from the stowed position $\mathbf{36}_S$ shown in FIG. 4A by removing the top pin 50 to free the pivot link 36 for upward movement. The bottom pin 52 can be removed from its stored position in the back bottom locking pin hole 66 when convenient. The gripping knob 70 is then used to raise the pivot link 36 into the linked position $\mathbf{36}_L$ shown in FIG. 4B. The top pin 50 is then inserted into the pivot link locking pin hole 66 in the outer and inner side plates 16, 18 of the side frame of the superjacent loudspeaker which is now aligned with the upper pin hole 116 of the pivot link 36. The bottom pin 52 then is inserted into the pivot link locking pin hole 62 of the outer and inner side plates 16, 18, thereby locking the pivot link 36 in the linked position $\mathbf{36}_L$ and interlinking the side frame to that of a superjacent loudspeaker as shown in FIG. 4C.

Figure 10A:
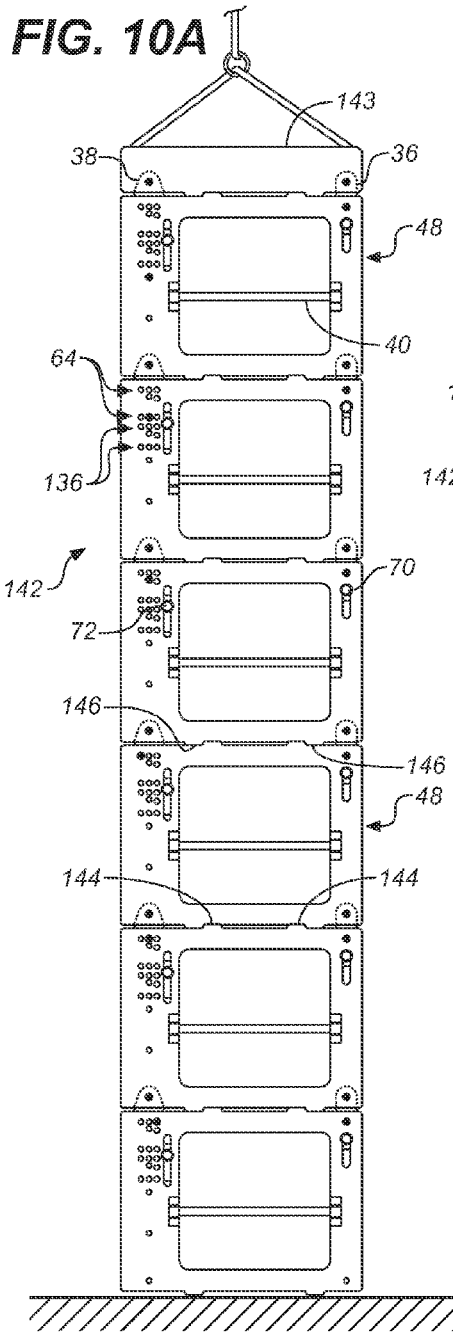
FIG. 10A is an elevation view of a stack of loudspeakers interlinked using a loudspeaker rigging system having upwardly extending connecting links according to the invention.
Figure 10B:
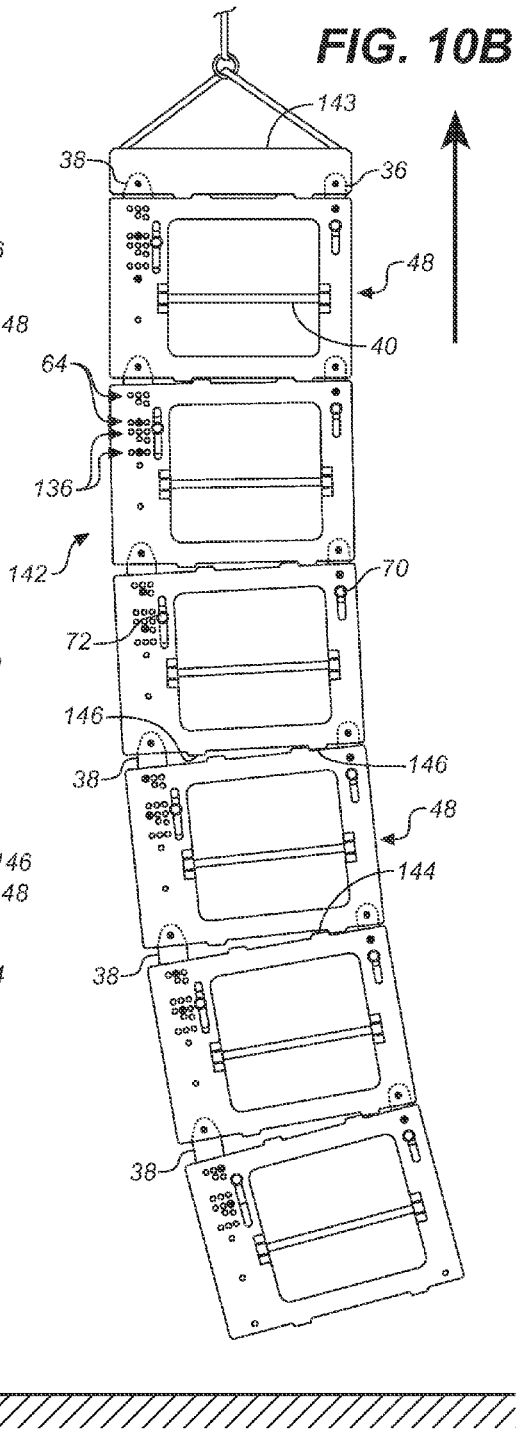
FIG. 10B is an elevation view showing the stack of interlinked loudspeakers shown in FIG. 10A in a flown position with the loudspeakers in the stack opened to a set of selected splay angle positions.
Figure 10C:
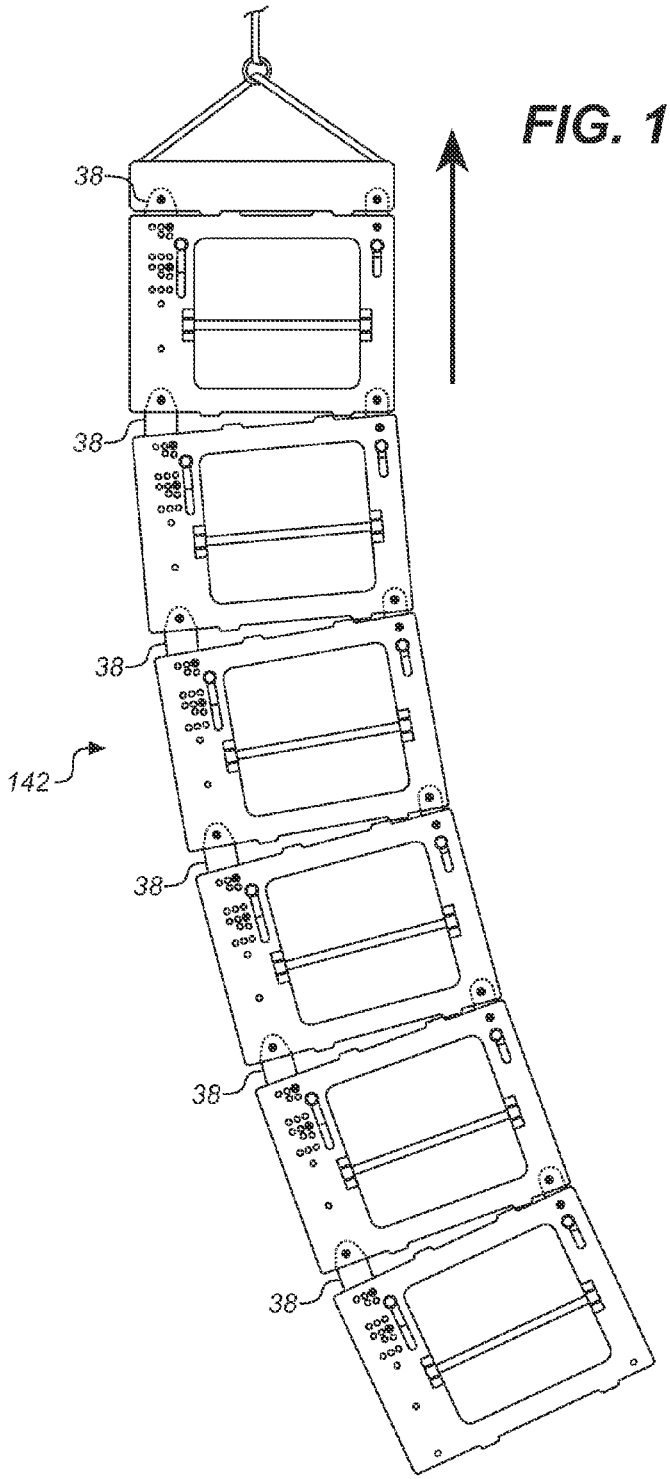
FIG. 10C is an elevation view showing the stack of interlinked loudspeakers shown in FIG. 10A in a flown position with the loudspeakers in the stack opened to a second set of selected splay angle positions.

In like fashion, the splay adjustment link 38 is released from its stowed position $\mathbf{38}_S$ by removing the top pin 50. The gripping knob 72 is then used to raise the splay adjustment link 38 to the linked position $\mathbf{38}_L$ shown in FIG. 4B at which point the top pin hole 92 of the splay adjustment link 38 aligns with the bottom locking pin hole 68 of the outer and inner side plates 16, 18 of the side frame of the superjacent loudspeaker. The top pin 50 is then inserted into the aligned holes 92, 68 to pin the splay adjustment link 38 to the side frame of the superjacent loudspeaker as shown in FIG. 4C. A bottom pin 52 is then inserted in a selected one of the splay angle selection pin holes 64 in the outer and inner side plates 16, 18. The steps to this point can be performed for the side frames of all of the loudspeakers that are being rigged into a stack of loudspeakers 142 such as that shown in FIG. 10A being hoisted by a pickup plate 143. The entire stack is then lifted which causes each of the splay adjustment links 38 to raise upward until the bottom edge 95 of the splay angle selection slot 94 through which the bottom pin 52 is inserted comes into contact with the bottom pin 52, as shown in FIG. 4D (but without showing the bottom pin 52), thereby setting the side frame of each loudspeaker at the desired splay angle with respect to the side frame of its superjacent loudspeaker in one lifting operation as shown in FIG. 10B. Once the stack of loudspeakers is lifted to a flown position, a bottom locking pin 52 may be inserted in the one of the splay angle locking pin holes 136 that aligns with one of the splay angle pin holes 96 in the splay adjustment link 38 as seen in FIG. 9. This locks the side frame of each loudspeaker at the designated splay angle with respect to the side frame of its superjacent loudspeaker. FIG. 10C is similar to FIG. 10B but shows the stack of loudspeakers 142 rigged with a different set of splay angles.

Referring once again to FIG. 1B, the frame structure 48 is provided with top and bottom locator tabs 144, 146. Locator tabs 144, 146 are provided in nesting pairs such that the top locator tabs 144 nest inside the bottom locator tabs 146 when the side frame of one loudspeaker in a stack of loudspeakers is placed on top of another loudspeaker in the stack such as shown in FIGS. 4C and 10A. Maneuvering the locator tabs 144, 146 into this nesting relation thereby positions the frame structures of vertically adjacent loudspeakers in precise front-to-back alignment. It will appreciated that these pairings could be rearranged or reversed to provide a similar nesting relationship.

Rigging a stack of loudspeakers using the upwardly extending links of the present invention presents a significant advantage over prior art rigging systems. Once the stack of loudspeakers is lifted upward using the upwardly extending links of the present invention, each pair of adjacent loudspeakers opens to the selected splay angle. Moreover, different splay angles can be selected for each pair of adjacent loudspeakers. Since the splay adjustment links automatically open to the selected splay angle, the side frames of each pair of adjacent loudspeakers can easily and quickly be locked in position using locking pins.

There have thus been described and illustrated certain preferred embodiments of a loudspeaker rigging system having upwardly extending connecting links according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

What is claimed is:

1. A rigging side frame for a loudspeaker which can be interconnected with rigging side frames of other loudspeakers for interconnecting loudspeakers in a stacked configuration, each interconnected loudspeaker having sides to which left and right rigging side frames can be mounted, the rigging side frame comprising:

a frame structure having a plurality of splay angle selection pin holes, and a splay adjustment link stowing channel, at least one locking pins, and an upwardly extendible splay adjustment link having a plurality of vertically extending splay angle slots of various lengths, each of said splay angle slots having a lower end, said splay adjustment link vertically movable in said splay link stowing channel between a linking position and a plurality of elevated splay angle positions, each of said elevated splay angle positions of said splay adjustment link associated with a splay angle of the frame structure of the rigging side frame of an adjacent loudspeaker relative to said frame structure, in said linking position:

said splay adjustment link is extended upwardly from said frame structure for pinning to the frame structure of the rigging side frame of a superjacent loudspeaker, and each of said plurality of splay angle selection pin holes of said frame structure is aligned with and spaced various lengths above the lower end of one of said plurality of splay angle slots, such that one of said at least one locking pins can be inserted in any selected one of said plurality of splay angle selection pin holes and in one of said plurality of splay angle slots, and in each of said plurality of elevated splay angle positions:

said splay adjustment link is elevated above its disposition in said linking position, and said one of said at least one locking pins is inserted in one of said plurality of splay angle slots and in a selected one of said splay angle selection pin holes, and is abutting the lower end of said selected splay angle slot, thereby preventing further upward movement of said splay adjustment link, such that by pinning said splay adjustment link to the frame structure of the rigging side frame of a superjacent loudspeaker in said linking position, inserting one of said at least one locking pins in one of said plurality of splay angle slots and in a selected one of said splay angle selection pin holes, and elevating said splay adjustment link from said linking position until the lower end of said splay angle slot abuts said locking pin, the frame structure of the rigging side frame of an adjacent loudspeaker is set at a selected one of said plurality of splay angle positions relative to said frame structure.

2. The rigging side frame for a loudspeaker of claim 1 wherein:

said frame structure includes a front top corner region, a front bottom corner region vertically opposite said front top corner region, said splay adjustment link stowing channel disposed in said front top corner region, said front bottom corner region having a splay adjustment link interlocking pin hole, said splay adjustment link has a top pin hole, said splay adjustment link is vertically movable in said splay adjustment link stowing channel between a stowed position and said linking position, said linking position being above said stowed position, and in said linking position said top pin hole is aligned with said splay adjustment link interlocking pin hole of the front bottom corner region of the frame structure of the rigging side frame of a superjacent loudspeaker for pinning said splay adjustment link thereto.

3. The rigging side frame for a loudspeaker of claim 2 wherein:

in said linking position a bottom locking pin is inserted in the top pin hole of said splay adjustment link and in the splay adjustment link interlocking pin hole of the front bottom corner region of the frame structure of the rigging side frame of an adjacent loudspeaker.

4. The rigging side frame for a loudspeaker of claim 2 wherein:

said top front corner region of said frame structure includes a plurality of splay angle locking pin holes, and said splay adjustment link has a plurality of splay angle pin holes, in any selected one of said plurality of elevated splay angle positions one of said plurality of splay angle pin holes aligns with one of said plurality of splay angle locking pin holes such that insertion of one of said at least one locking pins in one of said plurality of splay angle pin holes and in one of said plurality of splay angle locking pin holes locks said splay adjustment link in said selected elevated splay angle position.

5. The rigging side frame for a loudspeaker of claim 2 wherein:

said splay adjustment link has a top end including a rounded top surface, and said front bottom corner region of said frame structure includes a splay adjustment link receiving channel opposite said splay adjustment link stowing channel, said splay adjustment link receiving channel having a concave splay adjustment link guide surface corresponding to the rounded top surface of said splay adjustment link, such that when the top end of said splay adjustment link is lifted into the splay adjustment link receiving channel of the frame structure of the rigging side frame of a superjacent loudspeaker, said top surface engages said splay adjustment link guide surface to guide said splay adjustment link into said linking position.

6. The rigging side frame for a loudspeaker of claim 2 wherein:

in said stowed position said splay adjustment link is fully retracted in said splay adjustment link stowing channel.

7. The rigging side frame for a loudspeaker of claim 6 wherein:

in said stowed position one of the splay angle selection pin holes of the top front corner region of said frame structure is aligned with the top pin hole of said splay adjustment link for pinning said splay adjustment link in said stowed position.

8. The rigging side frame for a loudspeaker of claim 2 wherein:

said frame structure includes inner and outer side plates and a splay adjustment link frame member sandwiched between said inner and outer side plates.

9. The rigging side frame for a loudspeaker of claim 8 further comprising:

said outer side plate including a vertically extending front guide slot, said splay adjustment link includes a gripping knob attachment hole, and a front gripping knob attached to said gripping knob attachment hole and slidingly received in said front guide slot, said front gripping knob extending outwardly from said outer side plate and manually graspable such that moving said front gripping knob in said front guide slot moves said splay adjust link in said splay adjustment link stowing channel.

10. The rigging side frame for a loudspeaker of claim 1 further comprising:

said frame structure having a top back corner region and a bottom back corner region, said top back corner region including a pivot link stowing channel and a pivot link locking pin hole, said bottom back corner region having a pivot link interlocking pin hole, and an upwardly extendible pivot link having an upper pin hole and a lower pin hole, said pivot link vertically movable in said pivot link stowing channel between a retracted position and a raised interconnecting position, in said retracted position said pivot link retracted in said pivot link stowing channel, in said interconnecting position (a) said upper pin hole aligned with said pivot link interlocking pin hole of the bottom back corner region of the frame structure of the rigging side frame of a superjacent loudspeaker for pinning said pivot link thereto, and (b) said lower pin hole aligned with said pivot link locking pin hole for pinning said pivot link to said frame structure in said interconnecting position.

11. The rigging side frame for a loudspeaker of claim 10 wherein:

said pivot link has a convex top surface, and said bottom back corner region has a pivot link receiving channel disposed opposite said pivot link stowing channel, said pivot link receiving channel having a concave pivot link guide surface corresponding to the convex top surface of said pivot link, such that when said pivot link is lifted into said pivot link receiving channel, said top surface engages said pivot link guide surface to guide said pivot link into said interconnecting position.

12. The rigging side frame for a loudspeaker of claim 10 wherein:

in said retracted position said pivot link is fully retracted in said pivot link stowing channel.

13. The rigging side frame for a loudspeaker of claim 10 wherein:

in said retracted position the pivot link locking pin hole of the top back corner region of said frame structure and the upper pin hole of said pivot link are aligned for pinning said pivot link in said retracted position.

14. The rigging side frame for a loudspeaker of claim 10 wherein:

said frame structure includes inner and outer side plates, a splay adjustment link frame member and a pivot link frame member, said splay adjustment and pivot link frame members sandwiched between said inner and outer side plates.

15. The rigging side frame for a loudspeaker of claim 14 further comprising:

said outer side plate including a vertically extending back guide slot, said pivot link includes a gripping knob attachment aperture, and a back gripping knob attached to said gripping knob attachment aperture and slidingly received in said back guide slot, said back gripping knob extending outwardly from said outer side plate and manually graspable such that moving said back gripping knob in said back guide slot moves said pivot link in said pivot link stowing channel.

16. The rigging side frame for a loudspeaker of claim 1 wherein:

said frame structure includes a pair of spaced apart top locator tabs and a pair of spaced apart bottom locator tabs, said top locator tabs spaced apart a distance less than said bottom locator tabs are spaced apart such that said top locator tabs nest inside said bottom locator tabs when said frame structure is placed on top of the frame structure of the side frame of another loudspeaker in a stacked configuration.

17. A rigging side frame for a loudspeaker which can be interconnected with rigging side frames of other loudspeakers for interconnecting loudspeakers in a stacked configuration, each interconnected loudspeaker having sides to which left and right rigging side frames can be mounted, the rigging side frame comprising:

a frame structure having a front top corner region, a front bottom corner region vertically opposite said front top corner region, and a plurality of splay angle selection pin holes, said front top corner region having a splay adjustment link stowing channel, said front bottom corner region having a splay adjustment link interlocking pin hole, each of said plurality of splay angle selection pin holes associated with one of a plurality of splay angles of said frame structure relative to the frame structure of the rigging side frame of an adjacent loudspeaker, an upwardly extendible splay adjustment link having a top pin hole and a plurality of vertically extending splay angle slots of various lengths, each said splay angle slot having a lower end, said splay adjustment link vertically movable in said splay adjustment link stowing channel between a stowed position and a raised linking position, wherein in said stowed position said splay adjustment link is retracted in said stowing channel, and in said linking position:

said top pin hole is aligned with said splay adjustment link interlocking pin hole of the front bottom corner region of the frame structure of the rigging side frame of a superjacent loudspeaker for pinning said splay adjustment link thereto, and each of said plurality of splay angle selection pin holes of said frame structure is aligned with and spaced above the lower end of one of said plurality of splay angle slots, such that said splay adjustment link is movable from said linking position to a selected one of said plurality of elevated splay angle positions, and at least one locking pin, one of said at least one locking pins for insertion in a selected one of said plurality of splay angle selection pin holes and in an aligned one of said plurality of splay angle slots of said splay adjustment link while in said linking position, wherein in said selected one of said plurality of splay angle positions, the lower end of one of said plurality of splay angle slots is in abutting engagement with said locking pin, thereby limiting further upward movement of said splay adjustment link.

18. A rigging side frame for a loudspeaker which can be interconnected with rigging side frames of other loudspeakers for interconnecting loudspeakers in a stacked configuration, each interconnected loudspeaker having sides to which left and right rigging side frames can be mounted, the rigging side frame comprising:

a frame structure having a front top corner region, a front bottom corner region vertically opposite said front top corner region, top back corner region and a bottom back corner region, and a plurality of splay angle selection pin holes, said front top corner region having a splay adjustment link stowing channel, said front bottom corner region having a splay adjustment link interlocking pin hole, each of said plurality of splay angle selection pin holes associated with one of a plurality of splay angles of said frame structure relative to the frame structure of the rigging side frame of an adjacent loudspeaker, said top back corner region including a pivot link stowing channel and a pivot link locking pin hole, said bottom back corner region having a pivot link interlocking pin hole, an upwardly extendible splay adjustment link having a top pin hole and a plurality of vertically extending splay angle slots of various lengths, each said splay angle slot having a lower end, said splay adjustment link vertically movable in said splay adjustment link stowing channel between a stowed position and a raised linking position, wherein, in said stowed position said splay adjustment link is retracted in said stowing channel, and in said linking position:

said top pin hole is aligned with said splay adjustment link interlocking pin hole of the front bottom corner region of the frame structure of the rigging side frame of a superjacent loudspeaker for pinning said splay adjustment link thereto, and each of said plurality of splay angle selection pin holes of said frame structure is aligned with and spaced above the lower end of one of said plurality of splay angle slots, such that said splay adjustment link is movable from said linking position to a selected one of said plurality of elevated splay angle positions, at least one locking pin, one of said at least one locking pins for insertion in a selected one of said plurality of splay angle selection pin holes and through the aligned one of said plurality of splay angle slots of said splay adjustment link while in said linking position, in said selected one of said plurality of splay angle positions, said lower end of one said plurality of splay angle slots is in abutting engagement with said locking pin, thereby limiting further upward movement of said splay adjustment link, and an upwardly extendible pivot link having an upper pin hole and a lower pin hole, said pivot link vertically movable in said pivot link stowing channel between a retracted position and a raised interconnecting position, wherein, in said stowed position said pivot link is retracted in said pivot link stowing channel, and in said interconnecting position:

said upper pin hole is aligned with said pivot link interlocking pin hole of the bottom back corner region of the frame structure of the rigging side frame of a superjacent loudspeaker for pinning said pivot link thereto, and said lower pin hole is aligned with said pivot link locking pin hole for pinning said pivot link to said frame structure in said interconnecting position.

* * * * *